United States Patent [19]

Kandler et al.

[11] 4,302,647

[45] Nov. 24, 1981

[54] MEMBRANE TOUCH SWITCHES

[75] Inventors: James J. Kandler, Milwaukee; Peter H. Basler, Sussex; Gregory D. Schwehr, Milwaukee, all of Wis.

[73] Assignee: General Electric Company, Schenectady, N.Y.

[21] Appl. No.: 137,213

[22] Filed: Apr. 4, 1980

[51] Int. Cl.[3] ..... H01H 9/16; H01H 13/00

[52] U.S. Cl. ..... 200/159 B; 200/5 A; 200/16 A; 200/314

[58] Field of Search ..... 200/5 A, 16 A, 159 B, 200/314, 310, 311, 317

[56] References Cited

U.S. PATENT DOCUMENTS

| | | | |
|---|---|---|---|
| 4,056,701 | 11/1977 | Weber | 200/314 |
| 4,065,649 | 12/1977 | Carter et al. | 200/159 B |
| 4,090,045 | 5/1978 | Marsh | 200/159 B |
| 4,092,503 | 5/1978 | Raeder | 200/314 |
| 4,262,182 | 4/1981 | Busler et al. | 200/314 |

*Primary Examiner*—John W. Shepperd

*Attorney, Agent, or Firm*—Wheeler, House, Fuller & Hohenfeldt

[57] ABSTRACT

A laminated touch switch panel includes a lowermost insulating board having foil contacts on its top surface and a perforated uppermost board having foil contacts on its bottom surface. A perforated insulating spacer sheet has its bottom surface interfacing with the top of the lowermost board and its upper surface interfacing with an intervening flexible perforated membrane. The membrane has foil contacts on its upper surface which are normally closed with respect to the contacts on the bottom of the uppermost board and has contacts on its lower surface which are normally open with respect to the contacts on the lowermost board. Flexing the membrane with a force applied through the uppermost board opens the normally closed contacts and closes the normally open contacts. In one embodiment, contacts are kept normally closed with resilient elements that apply a force on the membrane which is overcome to open the contacts by applying a force through an aperture in the uppermost board.

7 Claims, 4 Drawing Figures

MEMBRANE TOUCH SWITCHES

Conventional touch switch panels comprise a non-conductive substrate on which thin metallic contacts are bonded. A spacer sheet having apertures that are congruent with the contacts on the substrate is adhered to the substrate. A thin flexible membrane is adhered to the spacer sheet and it has thin metallic contacts which are also congruent with the contacts on the substrate and kept normally open or separated from the contact on the substrate by the thickness of the spacer sheet. When the flexible membrane is depressed in a touch zone, that is, in alignment with an aperture, the contact on the membrane is flexed into contact with the contact on the substrate to complete an electric circuit. Usually there are thin foil conductors or leads connected to the contacts and bonded to the substrate and membrane for facilitating connecting the switch contacts in an external circuit. Touch switch panels which have only normally open contacts are conventional and have been commercially available heretofore.

Touch switch panels are frequently used to control the functions of medical apparatus such as x-ray, ultrasound and gamma ray camera apparatus which could be controlled more conveniently and safely if single pole-double throw or double pole-double throw membrane touch switches were available on the panel. For instance, greater control versatility could have been obtained if only one zone had to be touched on a touch switch panel to control multiple apparatus functions as would be possible if at least some switches had normally open contacts and others normally closed contacts or single switches had multiple open contacts and multiple closed contacts, or a combination of these characteristics in switches all on the same panel. Insofar as applicants are aware, however, no one has heretofore invented a touch switch panel which has anything but normally closed switch contacts on it.

SUMMARY OF THE INVENTION

An object of this invention is to demonstrate how normally open single-throw switches, normally closed single and double-throw switches, and switches having multiple contacts open and multiple contacts closed can be incorporated in a touch switch panel.

A further object is to so arrange the switch contacts such that backlighting of the touch zones can be achieved.

Briefly stated, in accordance with a preferred embodiment of the invention, the new touch switch panel comprises a nominally lowermost insulating circuit board or substrate which has thin single or multiple switch contacts on its upper surface. The thin contacts referred to herein may be formed in various known ways such as by etching them out of a metallic film or foil which is bonded to an insulating substrate as is done in making conventional printed circuit boards or, by way of further examples, the contacts may be foils adhered to a substrate, or they may be printed or silk screened on a substrate with ink entraining conductive metal particles such as silver or they may consist of deposited transparent films as when indium tin oxide is the conductive material. The term "foil" will be used herein in a generic way to designate any suitable thin contact irrespective of the method by which it is formed or of the conductive material of which it is formed.

An insulating spacer sheet is adhered to the top surface of the substrate or lowermost board. The spacer sheet has apertures which align with contacts on the board. A flexible membrane is adhered to the top surface of the spacer sheet and this membrane may have a thin foil shorting contact on its bottom surface aligned with the apertures in the spacer. The contacts on the substrate may be single or multiple cooperating contact pairs which may be short circuited by the shorting contact on the bottom of the membrane to complete an electric circuit when the membrane is depressed through the apertures. Thus, the switch just described, is a normally open, single-throw single or multiple contact switch.

Another foil shorting contact is affixed to the top surface of the membrane in line with the shorting contact on the bottom surface which was just described. The shorting contact on the top surface of the membrane aligns with a pair of foil contacts which are on the bottom surface of a rigid insulating board and which surround an aperture. The shorting contact on the top surface of the membrane is normally closed against the contacts on the bottom surface of the rigid insulating board. When a force is applied on the membrane over the aperture in the rigid board, the shorting contact on the top surface of the membrane is flexed away from the contacts on the bottom surface of the rigid board and the normally closed cooperating contacts become open. Of course, at the same time, the shorting contact on the bottom of the membrane is flexed through the aperture of the spacer sheet so the normally open single or multiple contact pairs on the substrate are short circuited to close the normally open switch contact pairs or pairs.

In an alternative embodiment, normally closed touch switches are implemented by locating resilient elements, such as foam pads or metallic or non-metallic cup washers and the like, in the spacer sheet apertures and having the resilient elements supported on the substrate board. The elements press against the bottom of the membrane to force its top short circuiting contacts agains the bottom contacts on the uppermost rigid board so that the contacts may be opened by applying a touch force on the membrane in alignment with the apertures in the uppermost board.

In the illustrated embodiments, lamp sockets are inserted in the substrate board within the contact areas and the membrane is covered by a film that has graphics printed on it within visibly defined touch zones so the lamps can illuminate the graphics and touch zones.

How the foregoing and other more specific objects of the invention are achieved will be evident in the ensuing more detailed description of illustrative embodiments of the invention which will now be set forth in reference to the drawings.

DESCRIPTION OF A PREFERRED EMBODIMENT

Figure 1:
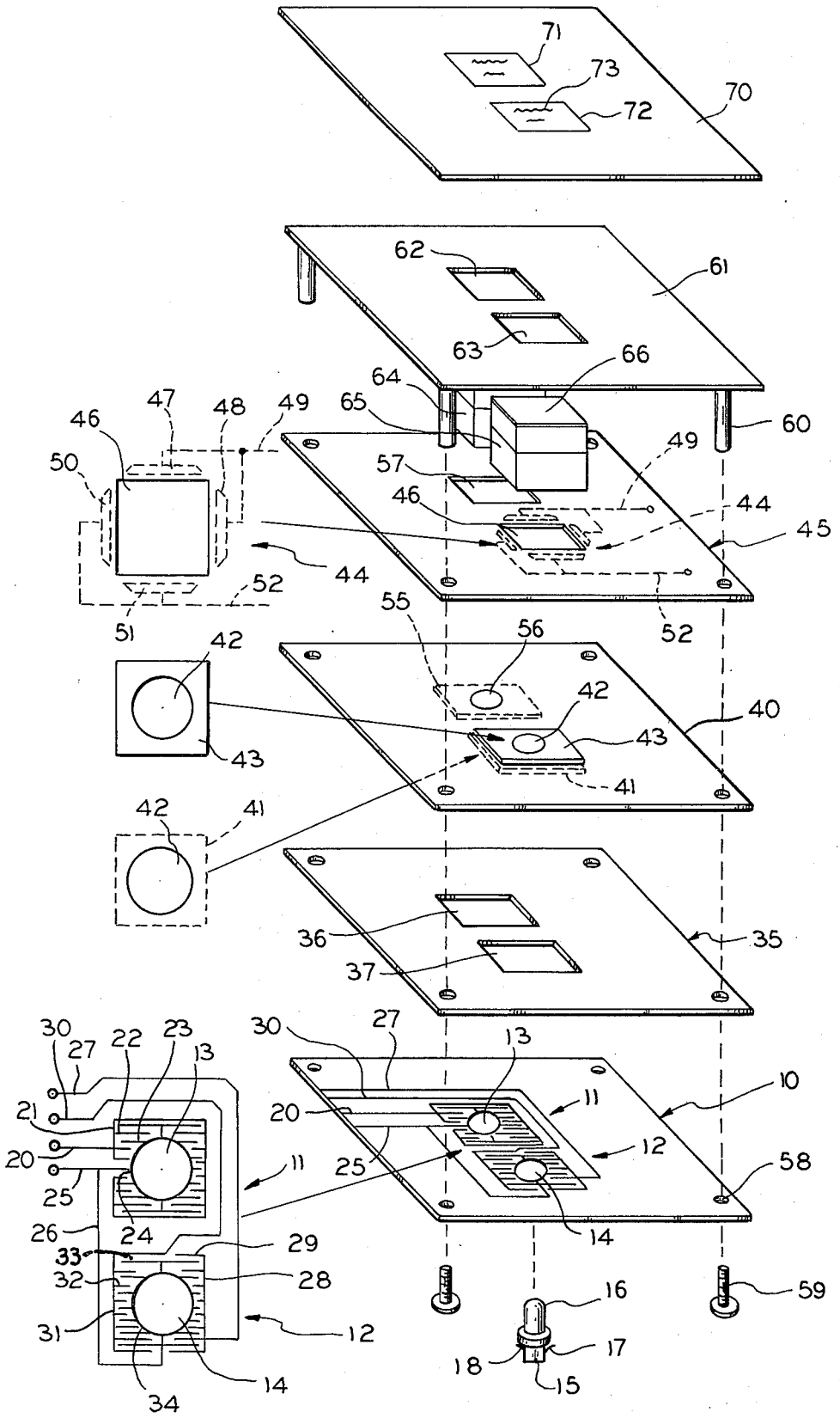
FIG. 1 is an exploded view of one embodiment of the new touch switch panel and also shows certain contacts set off at the side for enabling their construction to be seen more clearly.

Referring to FIG. 1, the illustrative touch switch panel comprises a nominally lowermost or substrate insulating board 10 which may be similar to a printed wire or printed circuit board. Board 10, in this example, has two foil contact assemblies, generally designated by the reference numerals 11 and 12, bonded to its top surface and these contact assemblies are of the interdigitated type in this example. There are holes 13 and 14 through circuit board 10 and the contacts 11 and 12, respectively. These holes are for receiving lamp sockets such as the one marked 15 which has a lamp 16 in it. The lamp sockets are a commercially available type which may be coupled to the substrate board 10 by inserting them in the holes and turning them to lock them in place. The lamps 16 then extend above the top surface of substrate board 10. Typical socket 15 has spring metal contacts such as those marked 17 and 18 which engage with pairs of foil contacts, respectively, which are fixed on the bottom of board 10 surrounding holes 13 and 14, for example. The contacts 19 for the lamp sockets on the bottom of the board are not shown in FIG. 1 for the sake of avoiding confusion but they are shown in section in FIG. 2 and similar contacts are shown in the FIG. 3 embodiment where they are marked 91 and 92.

There are also foil strips, not shown, fixed on the bottom of board 10 and running to the lamp socket contact pairs for enabling the lamp sockets to be connected to an external power supply, not shown. In an actual embodiment, substrate board 10, by way of example and not limitation, is about 0.06 of an inch thick. The foil contacts are a few mils thick as are the conductive leads which extend from them.

An enlargement of contact assemblies 11 and 12 is set off on the left side of substrate board 10 in FIG. 1 to facilitate description of these contact assemblies. Consider contact assembly 11 which is for use in a single-throw normally open single-pole switch. Contact assembly 11 has an input foil conductor or lead 20 running to it. This lead runs to a foil strip 21 which forms a square boundary for the contact. Strip 21 has several conductive foil strips, such as the one marked 22 extending from it inwardly toward hole 13. These finger-like strips 22 interdigitate with strips 23 which extend outwardly from a circular foil 24 to which a foil lead 25 serving as a common conductor connects. One may see that if a movable foil contact is pressed down on contact assembly 11, a short circuit or conductive bridge will be obtained between interdigitated contact strips 22 and 23 and their counterparts to thereby effectively close a switching circuit between leads 20 and 25 to which an external device may be connected.

A conductor 26 runs from common conductor 25 to contact assembly 12 which is part of a normaly open single-throw double-pole switch. There are two circuits or paths through contact assembly 12 to common foil lead 26. One path begins with foil lead 27 which runs to a foil perimetral band 28 from which a plurality of narrow finger strips 29 extends. Another path begins with lead strip 30 which extends to perimetral band or strip 31 from which a plurality of narrow finger strips 32 extend. Finger strips 29 interdigitate with some narrow strips 33 which extend from circular strips 34 that is also connected to common foil lead strip 26. It will be evident that by causing a short circuit between narrow strips 32 and strips 33 extending from the circular strip 34, that a circuit will be completed between foil lead 30 and common lead 26. Similarly. if a short circuit is created between between narrow strips 29 and the strips 33 extending from circular strip 34, a circuit will be closed between lead 27 and common conductor 26.

In FIG. 1, an insulating spacer sheet 35 with pressure sensitive adhesive on its bottom surface is adhered to substrate board 10. By way of example, in an actual embodiment spacer sheet 35 is about 0.015 of an inch thick plastic identified by the trademark Mylar but it could be polyester or other suitable insulating material. Spacer sheet 35 has two square apertures 36 and 37 which correspond with touch switch positions. When spacer sheet 35 is adhered to substrate board 10, its apertures 36 and 37 are congruent with upwardly presented foil contact assemblies 11 and 12 on board 10.

In FIG. 1, a flexible membrane 40 has its bottom surface adhered to the top surface of spacer sheet 35. The bottom surface of membrane 40 has a large area square foil short circuiting contact 41 which is shown in hidden or dashed lines and is congruent with aperture 37 in spacer sheet 35. Short circuiting contact 41 is shown in plan view set off to the left side of membrane 40. Foil contact 41 has a central hole 42 coincident with a similar hole in membrane 40 for permitting the touch zone illuminating lamp 16 to extend upwardly through the laminated assembly comprised of membrane 40, spacer sheet 35 and substrate board 10. Short circuiting contact 41 cooperates with contact assembly 12 on the substrate board to form a single-throw double-pole normally open switch. The switch is maintained in normally opened condition by virtue of spacer 35 keeping shorting contact 41 in spaced relationship to contact assembly 12.

When a downward force is applied to the top surface of membrane 40 within the boundaries of shorting contact 41, this contact flexes through aperture 37 of the spacer sheet and effectuates a short circuit between the interdigitated fingers or strips constituting the contact pairs in assembly 12 which were previously described in detail. To reiterate, when shorting contact 41 engages contact assembly 12, as can be traced in the enlargement of this contact at the left side of substrate 10, foil lead 30 becomes effectively connected with common line 26 and foil lead 27 becomes effectively connected with common line 26 by virtue of the short circuit created between the interdigitated finger strips by short circuiting contact 41.

The top surface of membrane 40 has another foil shorting contact 43, shown in solid lines, and depicted in plan view to the left of membrane 40 in FIG. 1. This contact also has a central hole 42 for lamp 16 to extend through. Short circuiting contact 43 on the top surface of membrane 40 cooperates with a contact set 44 on the bottom surface of a rigid insulating board 45 whose bottom surface is adhered to the top surface of membrane 40. Contact set 44 surrounds an aperture 46 in insulating board 45. The contact set is depicted in plan view to the left of insulating board 45. Contact set 44 comprises two foil contact segments 47 and 48 which are mutually connected to a conductive foil lead 49. These segmented foil strips 47 and 48 are effectively one contact. Contact set 44 also includes another pair of foil strips or segments 50 and 51 which are mutually connected to a conductive foil lead 52. The pair of contacts in set 44 cooperates with shorting contact 43 on membrane 40 to form a normally closed single-pole single-throw switch. Thus, normally, shorting contact 43 establishes a closed circuit between foil leads 49 and 52. However, when a downward force is applied to the top surface of contact 43 through aperture 46 in board 45, contact 43 and the membrane which supports it flexes away from contact set 44 and the contact pairs in this set become open circuited.

The touch switch panel in FIG. 1 also illustrates having single-throw normally open touch switches in the same panel that contains other normally open and normally closed switch combinations. The illustrative normally open switch comprises a short circuiting foil contact 55 on the bottom surface of membrane 40 which has a hole 56 in it aligned with a similar hole in the membrane for a touch zone illuminating lamp to extend through. Short circuiting contact 55 is aligned with aperture 36 in spacer sheet 35 and congruent with contact assembly 11 on the top of substrate board 10. Contact 55 aligns with aperture 36 in spacer sheet 35. Short circuiting contact 55 is normally maintained in spaced relationship with contact assembly 11. When a force is applied to the top surface of membrane 40 within the boundaries of short circuiting contact 55, this contact flexes through aperture 36 and bridges the gaps between the interdigitated foil strips which comprise contact assembly 11. As explained earlier in reference to the contact assemblies depicted at the left of substrate board 10, making short circuiting contact 55 engage interdigitated contact assembly 11 results in a circuit being completed between foil lead 20 and common foil lead 25. It may be noted that the force for flexing short circuiting contact 55 is applied through an aperture 57 in insulating board 45.

Referring further to FIG. 1, one may see that a thin laminated switch panel subassembly is formed by the interfacing and adhering upper contact board 45, membrane 40, spacer sheet 35 and substrate printed circuit board 10. Near the four corners of each of the layers in this laminated structure there are holes such as the one marked 58 in the corner of substrate board 10. These holes are for letting a screw such as the one marked 59 engage in spacer posts such as the one marked 60 which have threaded holes, not visible, in their lower ends and extend from a rigid support plate 61. Spacer posts 60 keep the laminated assembly in parallel spaced relationship with rigid supporting plate 61.

Figure 2:
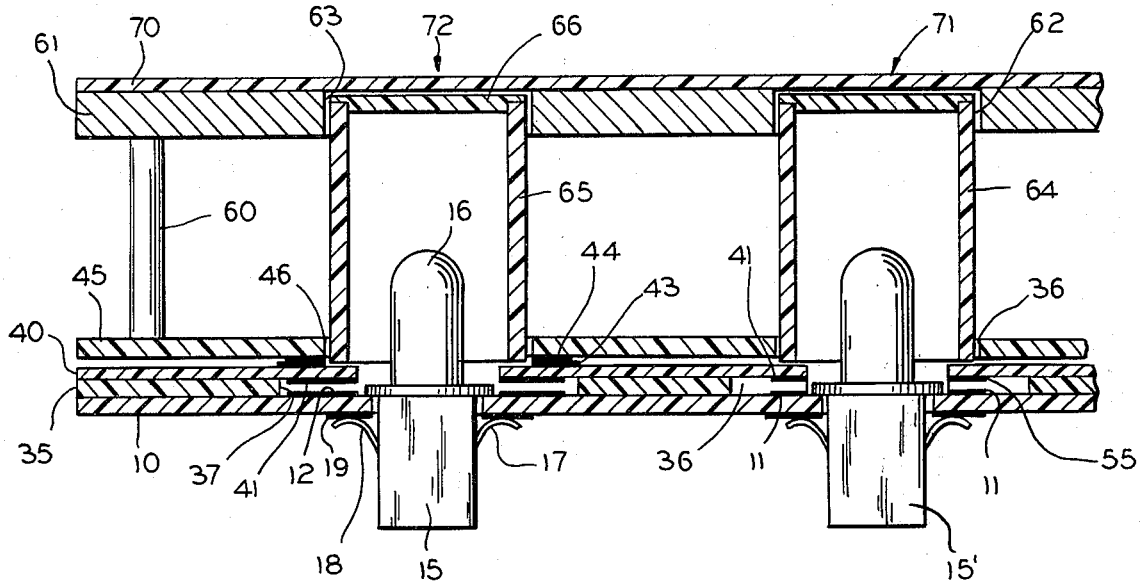
FIG. 2 is a partial section of a panel through a plane which includes two kinds of touch switch assemblies, the left one having normally closed and normally open contacts responsive to a single touch and the right one having only normally open contacts.

Support plate 61, in this example, has two apertures 62 and 63 which are essentially congruent with apertures 57 and 46, respectively, in insulating board 45. For every touch switch position, which is basically defined by apertures similar to 62 and 63, there is a dual function touch switch operating plunger and light conduit element such as those marked 64 and 65. Elements 64 and 65 are basically tubular and are like open-bottomed boxes, preferably molded of opaque plastic material. Each box element is closed at its top with an inset translucent light diffuser plate such as the one marked 66. As can be seen in FIG. 2 particularly well, the shape of light conducting element 65 is such that its upper end can fit loosely in aperture 63 in support plate 61 and its lower end can fit loosely in aperture 46 of plate 45. As can be seen in FIG. 2, the lower end of hollow plunger 65 rests on membrane 40 which overhangs the aperture in spacer sheet 35 such that when the plunger is depressed, normally closed contacts 43 and 44 are caused to open and normally open contact 41 and cooperating contact set 12 are caused to close.

The manner in which the light source 16 extends into combination light channel and plunger 65 can also be seen clearly in FIG. 2. The split contact 19 on the bottom of substrate board 10 with which the spring contacts 17 and 18 of the socket engage are also evident in FIG. 2.

As can be seen in FIGS. 1 and 2, a thin plastic film 70 is adhered to the top surface of plate 61. In FIG. 1 two of the touch zones 71 and 72 are defined on film 70. Film 70 is opaque practically everywhere but in the touch zones which are translucent. Like the rest of the film 70, the translucent touch zones may be matted to enhance light diffusion and distribution over the touch zones 71 and 72. Of course, diffusion is further enhanced by diffuser plates 66 which underly each touch zone. Within the borders of the touch zones and on the bottom of film 70, graphic information for identifying touch switch functions may be printed. Graphics are indicated by the irregular lines marked 73. It wll be evident that when finger pressure is applied to any touch zone which controls a double throw switch such as the one at the left in FIG. 2, finger force will be transmitted through the immediately underlying combination light channel and plunger element 65 to open the normally closed contacts by deflection of the membrane and to close the normally open contacts. When finger pressure is released, the membrane restores back to a planar condition.

In the right portion of FIG. 2, associated with the lamp socket marked 15', one may see how the normally open switch comprised of shorting contact 55 and contact assembly 11 is arranged. In this switch, pressing plunger 64 downwardly through a force applied to touch zone 71 will cause the switch comprised of shorting contact 55 and interdigitated contact assembly 11 to engage as a result of deflection of membrane 40 which overhangs apertures 36 in spacer sheet 35. Here again, release of the touch switch zone 71 will allow the membrane to self-restore to its planar state so the pairs of contacts will be separated again.

Figure 4:
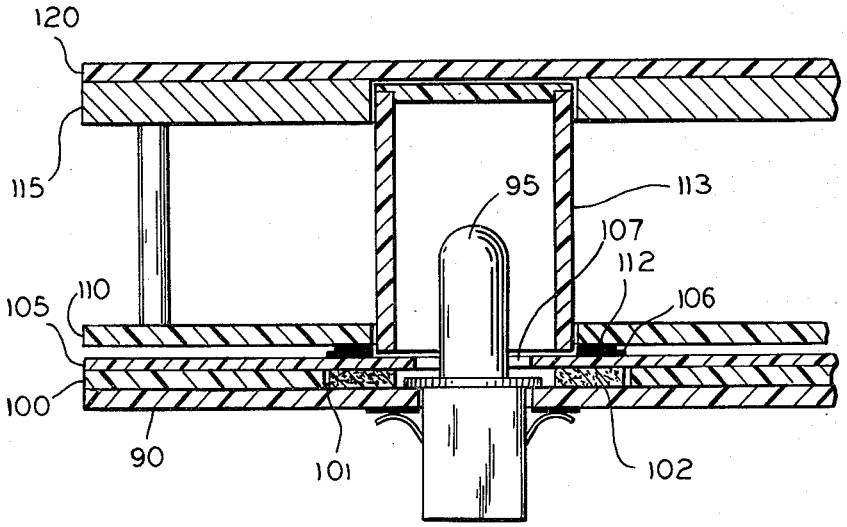
FIG. 4 is a section through one of the touch switch assemblies illustrated in FIG. 3.
Figure 3:
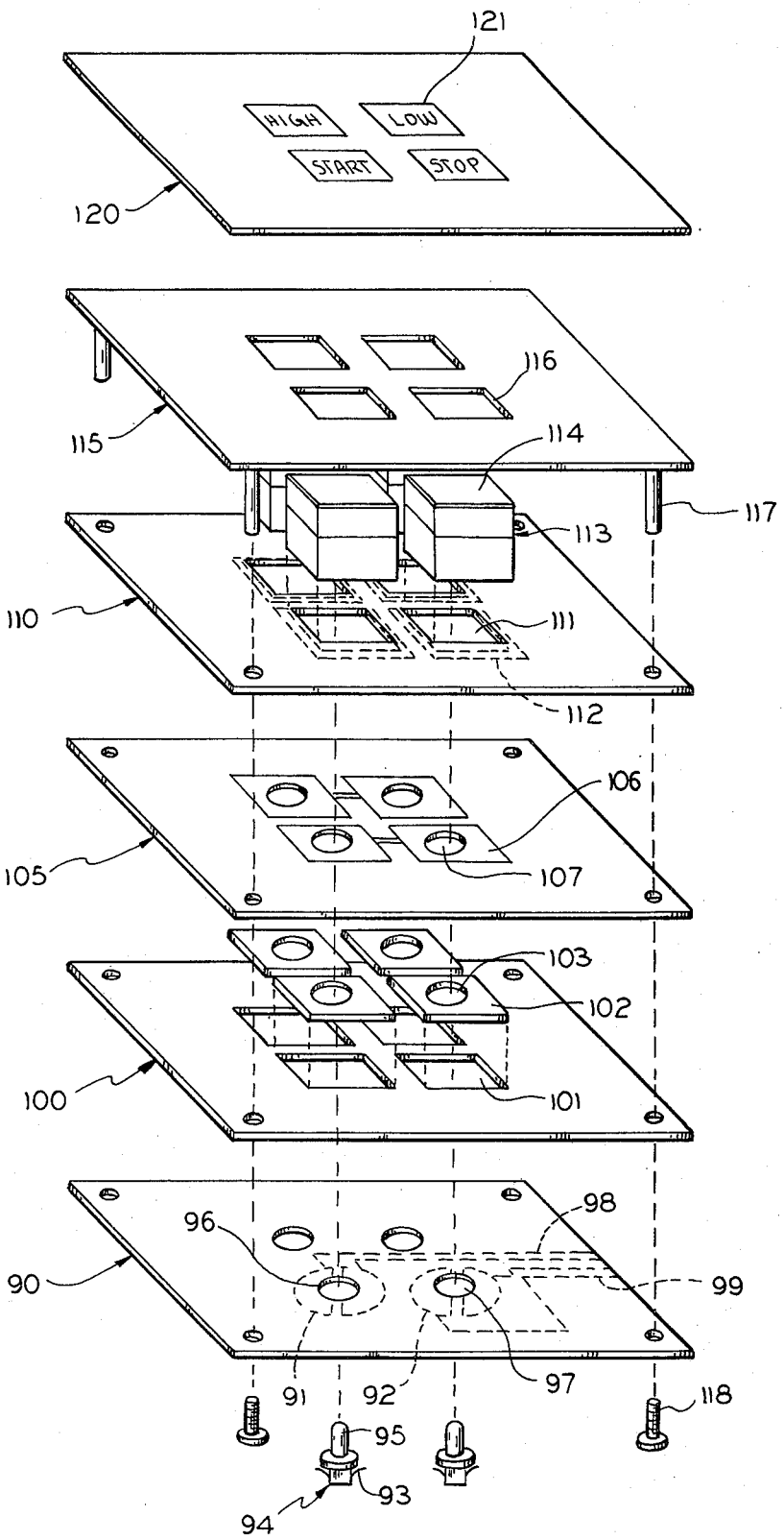
FIG. 3 is an exploded view of another embodiment of a touch switch panel which achieves the normally closed switch function by use of resilient elements which may be compressed to effect opening of the cooperating normally closed contacts.

An alternative embodiment of a touch switch panel which includes a type of normally closed switch that differs from the type described in connection with the FIGS. 1 and 2 embodiment is depicted in FIGS. 3 and 4 where a new sequence of reference numerals will be used even through some of the parts are similar to parts in the previous embodiment.

The FIG. 3 touch switch panel comprises an insulating substrate board 90 which is illustrated as having two foil contact pairs 91 and 92 on its bottom surface for making electrical connections with the spring contacts 93 of lamp socket 94 which typically has lamp 95 in it. The sockets insert and lock in holes such as 96 and 97 which are surrounded by the split semicircular contacts 91 and 92. A plurality of conductive foil leads such as those marked 98 and 99 run along the bottom surface of the board 90 to provide for connecting into an outside electrical circuit, not shown.

A plastic spacer sheet 100 has its bottom surface interfaced with and adhered to the top surface of board 90. Spacer sheet 100 is illustrated as having four similar rectangular apertures, a typical one of which is marked 101. The number of apertures would correspond with the number of touch switches in any particular panel. A resilient element such as the pad marked 102 is set in aperture 101 so the pad may be backed up by the top surface of substrate board 90. These pads 102 may be made of any suitable resilient synthetic resin foam or soft homogeneous rubber, for instance. The pads have a thickness which is just about equal to or slightly thicker than spacer sheet 100.

Resilient elements 102 do not necessarily have to be pads. They could be springy solid elements, similar to belleville washers, or springs and the like as long as they have enough resistence to restore a membrane to planar or unflexed condition. Each resilient element has a hole 103 through which the light source or lamp 95 can extend.

A flexible membrane 105, similar to membrane 40 in the FIG. 1 embodiment, has its bottom surface interfaced with the top surface of spacer sheet 100 such that the resilient elements 102 are retained in the recess created by apertures 101. The bottom surface of membrane 105 bears on the top surface of resilient elements 102 but the elements are not so thick as to cause any significant bulging of the membrane. There are foil contacts such as the one marked 106 on the top surface of membrane 105 for each switch position. Each contact has a central hole 107 through which a light source can project.

A rigid insulating board 110 has its bottom surface interfaced with and adhered to the top surface of membrane 105. Board 110 has an aperture such as the one marked 111 for each switch position. On the bottom surface of board 110 and surrounding each aperture 111 there is a foil contact assembly 112 comprised of foil segments formed as an open-centered frame similar to contacts 44 in FIG. 1. When the bottom of board 110 and the top of membrane 105 are interfaced, the normally uncompressed resilient element 102 will force short circuiting contact 106 on membrane 105 against segmented contact 112 on the bottom surface of board 110 so that a closed electric circuit is formed between contact segments of 112. The conductive foil leads which connect to each of these contacts and run along the board and membrane surfaces have been ommitted from this view but it wlill be understood that in the actual embodiment they are present.

An open-bottomed combination light channel and switch plunger element 113 fits loosely into aperture 111. This element has a diffuser 114 closing its top. Element 113 and diffuser 114 are similar to element 65 and its diffuser 66 in the FIG. 1 embodiment. The lower edge of hollow element 113 normally rests on the top of contact 106 on the top surface of membrane 105 but the weight of element 113 is not by itself sufficient to flex the membrane and the thin contact 112 thereon so that resilient element 102 is not normally compressed. However, when a force obtained from a finger touch on a touch zone in top film 120 is transmitted through box-like plunger element 113, the resilience of element 102 is overcome and it compresses. This allows foil shorting contact 106 on the top of membrane 105 to deflect away from segmented contact 112 on the bottom of board 110 to thereby open what had been formerly a normally closed pair of segmented contacts 112. In an actual embodiment, the width of the foil segments which comprises contact 112 is relatively small 0.05 inch wide, for example, so that complete separation of all parts of contact 112 and the large area contact 106 is assured even though the amount of flexing or bending of the membrane is rather small.

A rigid plate 115 is secured in spaced relationship with the laminated structure comprised of board 110, membrane 105, spacer sheet 100 and board 90. Plate 115 has a plurality of apertures such as the one marked 116 which permits the upper ends of plunger elements 113 to extend into them so that the top surface of diffuser 114 is substantially flush with the top surface of plate 115. The plungers fit loosely into apertures 116. The laminated structure composed of board 90, spacer 100, membrane 105 and board 110 is secured to the internally threaded bottom ends of spacer posts 117 which extend from the bottom of plate 115. The laminated structure is secured to these posts by passing the threaded shank of a typical one of four machine screws 118 through holes in the corners of each of the layers that composes the laminated structure.

The combination switch operating and light channeling plungers such as 64 and 65 in the FIG. 1 embodiment and 113 in the FIG. 3 embodiment are derived from an invention relating to touch switch panels described in co-pending application Ser. No. 111,156, filed Jan. 11, 1980.

As in the FIG. 1 embodiment, the FIG. 3 embodiment has an uppermost film 120 adhered to the top surface of plate 115. This film is preferably matte finished and is opaque except in touch zones such as the one marked 121 where they are translucent. The graphics within each touch zone are printed on the bottom surface of flexible sheet 120 so the printing is not subjected to wear as a result of a touch zone being touched frequently for the purpose of operating a switch.

A section of a normally closed single throw touch switch assembly as is used in FIG. 3 is shown in FIG. 4 where its details may be more easily perceived. Here one may see how the resilient element 102 is set in the recess formed by aperture 101 in incompressible rigid spacer 100. One may also see how the flexible self-restoring membrane 105 bears directly on resilient element 102 such that the contact 106 on the upper surface of membrane 105 is maintained in normally closed contact relationship with foil contact 112 which is on the bottom of rigid board 110. It will be evident that when plunger 113 is depressed by exertion of a manual force on the top of graphics bearing film 120, the force will be transmitted through plunger 113 to cause the marginal area around the hole 107 in the membrane to flex downwardly in opposition to the elastic or resilient element 102 to permit contacts 106 and 112 to open. When the fingertip force on the plunger 113 is released, resilient element 102 rebounds and straightens out the membrane to thereby close contacts 106 and 112.

Although illustrative embodiments of normally closed and normally open multiple-pole and single-pole and single and double-throw membrane touch switches have been described in considerable detail, such description is intended to be illustrative rather than limiting, for the switches may be variously embodied and are to be limited only by interpretation of the claims which follow.

I claim:

1. A touch switch device comprising:

a planar substrate member, a spacer sheet superimposed on said substrate member and having an aperture defining a recess which has a depth substantially equal to the thickness of the sheet, a deflectable membrane having a nominally top surface and a nominally bottom surface superimposed over said sheet and extending over said recess, said membrane having first thin short circuiting switch contact means on its top surface aligned with said recess, a rigid insulating member having its nominally bottom surface superimposed on said top surface of the membrane and having thin spaced apart switch contact elements on its bottom surface aligned with and normally in contact with said contact on the top surface of the membrane, said rigid insulating member having an aperture aligned with said recess, and plunger means for extending into said aperture in the insulating member and being movable to deflect said membrane in the vicinity of said recess to cause said contact on the membrane to separate from the contact elements on said insulating member.

2. The touch switch device as in claim 1 wherein:

said substrate member and said membrane each have a hole aligned with each other and with the aperture in the sheet which defines said recess for admitting a light source into said plunger means, said plunger means being a hollow element having an open end which passes through said insulating member aperture to said membrane and having a light transmissive closure at its opposite end, said contacts on the bottom surface of said insulating member being located adjacent said plunger, a plate secured in spaced relationship to said rigid insulating member and having an aperture into which the closed end of said plunger means extends, and a film superimposed on said plate for being touched in a zone aligned with said plunger means for said deflecting of said membrane to separate said contacts.

3. The touch switch device as in any of claims 1 or 2 including:

a resilient element disposed in said recess and interposed between the substrate and the bottom surface of the membrane for pressing the contact on the membrane against the contact elements on said rigid insulating membrane and for yielding under the force of said plunger means to enable said contact and contact elements to separate.

4. A touch switch device comprising:

a planar nonconductive substrate member, thin spaced apart foil contact elements on the nominally top surface of said substrate member, said contact elements being part of a normally open touch switch, an insulating spacer sheet having a nominally top surface and a nominally bottom surface superimposed on the top surface of said substrate and having an aperture aligned with said contact elements, a deflectable membrane having a nominally top surface and a nominally bottom surface superimposed on the top surface of said spacer sheet, said membrane having thin foil short circuiting contact means on its bottom surface aligned with said aperture in the spacer sheet and being another part of said normally open switch and having thin foil short circuiting contact means on its top surface located over the contact means on its bottom surface, said last named contact means being part of a normally closed switch, and a rigid planar insulating member having its nominally bottom surface superimposed on the top surface of the membrane and having an aperture aligned with said short circuiting contact on the top surface of the membrane, and thin spaced apart foil contact elements on the bottom surface of said insulating member adjacent its aperture and forming another part of said normally closed switch and being normally engaged simultaneously by said short circuiting contact on the top surface of said membrane, deflection of said membrane by a touch force applied to its top surface causing said short circuiting contact on the top surface of said membrane to separate from said contact elements on the bottom surface of said insulating member to thereby open said normally closed switch and to cause said short circuiting contact on the bottom surface of said membrane to deflect and engage said contact elements on said substrate member to thereby close said normally open switch.

5. The touch switch device as in claim 4 wherein said foil contact elements on said substrate member include one contact element which serves as a common conductor and at least two other contact elements which are electrically isolated from said common contact element and each other and are connected to said common element by said short circuiting contact on the bottom surface of the membrane to thereby provide for closing multiple circuits simultaneously.

6. The touch switch device as in claim 5 wherein said foil contact elements on said substrate member are mutualy interdigitated.

7. The touch switch device as in claim 4 wherein said substrate member, said membrane and said contacts each have an opening aligned with the aperture in the spacer sheet for accommodating a light source, a hollow plunger element having an open end which passes through said insulating member aperture to contact said membrane and has a light transmissive closure at its opposite end, a plate secured in spaced relationship to said rigid insulating member and having an aperture into which the closed end of said plunger extends, and a film superimposed on said plate for being touched in a zone aligned with said plunger for deflecting said membrane to move said contacts on the membrane.

* * * * *